US005486042A

United States Patent [19]

Heisler et al.

[11] Patent Number: 5,486,042

[45] Date of Patent: Jan. 23, 1996

[54] FURNITURE ARRANGEMENT

[75] Inventors: William A. Heisler, East Grand Rapids; David A. Shipman, Grand Rapids; Anthony A. Stachowiak, Belmont, all of Mich.; Kurt S. Bodden, Hudson, Ohio; Michael E. Wurth, Grand Rapids, Mich.; Norbert Dellekoenig, Effingham, Ill.

[73] Assignee: Steelcase, Inc., Grand Rapids, Mich.

[21] Appl. No.: 118,895

[22] Filed: Sep. 9, 1993

[51] Int. Cl.[6] ..... A47B 17/00

[52] U.S. Cl. ..... 312/196

[58] Field of Search ..... 52/241; 312/196; 108/24, 155, 154, 158, 187

[56] References Cited

U.S. PATENT DOCUMENTS

| | | |
|---|---|---|
| D. 171,630 | 3/1954 | Zimmerman . |
| D. 194,847 | 3/1963 | Rice et al. . |
| D. 240,184 | 6/1976 | Neuschaefer . |
| D. 269,237 | 6/1983 | Burdick . |
| D. 277,625 | 2/1985 | Hannah . |
| D. 281,294 | 11/1985 | Hoppe . |
| D. 286,832 | 11/1986 | Matthews et al. . |
| D. 304,530 | 11/1989 | Bush et al. . |
| D. 324,963 | 3/1992 | LaCour . |
| 1,826,670 | 10/1931 | Ohnstrand . |
| 1,873,932 | 8/1932 | Hunter . |
| 2,230,444 | 2/1941 | Balster . |
| 2,323,107 | 6/1943 | Wilson . |
| 2,461,823 | 2/1949 | Jones . |
| 2,793,926 | 5/1957 | Deaton . |
| 2,821,450 | 1/1958 | Knoll . |
| 2,942,924 | 6/1960 | Stangert . |
| 2,987,362 | 6/1961 | Bernath . |
| 3,000,681 | 9/1961 | Long . |
| 3,105,726 | 10/1963 | Jung . |
| 3,125,387 | 3/1964 | Abrahamson . |
| 3,140,135 | 7/1964 | Stohlberg . |
| 3,169,810 | 2/1965 | Levy et al. . |
| 3,233,952 | 2/1966 | Valentine . |
| 3,361,090 | 1/1968 | Howlett . |
| 3,413,053 | 11/1968 | Featherston . |
| 3,806,220 | 4/1974 | Payne . |
| 3,838,902 | 10/1974 | Tenani . |
| 3,877,764 | 4/1975 | Hillier, Jr. . |
| 3,927,924 | 12/1975 | Kelley . |
| 4,050,752 | 9/1977 | Dykstra . |
| 4,067,631 | 1/1978 | Kelley . |
| 4,094,561 | 6/1978 | Wolff et al. . |
| 4,106,630 | 8/1978 | Rosenband . |
| 4,145,097 | 3/1979 | Naess et al. . |
| 4,145,098 | 3/1979 | Alexander . |
| 4,154,493 | 5/1979 | Prater . |
| 4,163,592 | 8/1979 | Nelson . |
| 4,206,576 | 6/1980 | Walz . |
| 4,226,488 | 10/1980 | Vincent . |
| 4,287,837 | 9/1981 | Bayles ..... 108/154 |
| 4,323,291 | 4/1982 | Ball . |
| 4,372,629 | 2/1983 | Propst et al. . |
| 4,379,429 | 4/1983 | Gubbe et al. . |
| 4,536,044 | 8/1985 | Ziegelheim et al. . |
| 4,560,215 | 12/1985 | Turner . |

(List continued on next page.)

*Primary Examiner*—James R. Brittain
*Assistant Examiner*—Gerold B. Anderson
*Attorney, Agent, or Firm*—Price, Heneveld, Cooper, DeWitt & Litton

[57] ABSTRACT

A furniture unit includes a worksurface, a supporting base formed by a supporting pedestal and/or a supporting end panel, and a pair of rails connected to the underside of the worksurface reinforcing the worksurface and acting as a standoff between the worksurface and the supporting base, the rails including apertures spaced longitudinally along their length. A bracket is provided including an elongate bayonet-like leg for releasably engaging the apertures in the rail and further includes an accessory supporting end that extends laterally of a worksurface edge. A plurality of accessory units are selectively mounted to the bracket in a position spaced above the worksurface, thus allowing a user to select and position one or more of the accessory units along the edge of the worksurface for optimal use and efficiency of the furniture unit.

29 Claims, 11 Drawing Sheets

U.S. PATENT DOCUMENTS 4,562,482 12/1985 Brown .
4,600,248 7/1986 Pfliefer .
4,619,486 10/1986 Hannah et al. .
4,644,875 2/1987 Watt .
4,734,826 3/1988 Wilson et al. .
4,736,689 4/1988 Stanko .
4,755,009 7/1988 Price et al. .
4,766,422 8/1988 Wolters et al. .
4,815,395 3/1989 Trueg ..... 108/187
4,879,955 11/1989 Moll et al. .
4,883,330 11/1989 Armstrong et al. .
4,884,513 12/1989 Newhouse et al. .
4,886,326 12/1989 Kuzyk .
4,931,978 6/1990 Drake et al. .
4,948,205 8/1990 Kelley .
5,058,964 10/1991 Reuschel et al. .
5,071,204 12/1991 Price et al. .
5,094,174 3/1992 Grund et al. .
5,106,173 4/1992 Kelley et al. .
5,118,172 6/1992 Ugalde .
5,121,698 6/1992 Kelley .
5,142,996 9/1992 Thorn .

FURNITURE ARRANGEMENT

BACKGROUND OF THE INVENTION

The present invention relates to furniture for offices and the like, and in particular to a novel customizable knock-down furniture arrangement with attachable accessories.

The furniture industry has become increasing competitive, and as a result, furniture manufactures are searching for furniture arrangements that maximize functionality and the ability of customers to customize the furniture to the customer's particular needs, but which also minimize manufacturing costs and shipping costs. One attractive alternative has been to provide knockdown furniture with interchangeable/interconnectable components that can be ordered with the desired options, shipped in a knocked-down condition to minimize shipping costs, and assembled on-site. However, further improvements are desired to reduce part cost and assembly time, to reduce the need for skilled labor and special tools particularly at the job site, and to reduce the number of non-standardized specialized brackets and other parts. Notably, each of these items can add considerably to the overall cost and expense of the furniture. Also, a furniture arrangement is desired that allows ready reconfiguration of an existing furniture arrangement without the need for additional or different connectors and without a difficult disassembly/reassembly.

Aside from the items noted above, businesses in general are placing an increased emphasis on efficient use of office space, which has led to an overall increase in worker density. This in turn has placed a premium on efficient use of worksurface space. At the same time, computers are being introduced which take up additional worksurface space placing even more of a premium on worksurface space. Thus, improvements are desired in the type and placement of worksurface accessories, and in particular, improvements are desired which free up worksurface space but which simultaneously allow optimal placement of the accessories and allow the accessories to be easily replaced or relocated to permit adaptation to changing work needs and functions. Of particular interest is a low cost desk adapted for use with a computer which allows periodic uninhibited use of the computer while permitting the computer keyboard to be stored in an accessible but remote location so that the desk presents a worksurface unencumbered by the computer keyboard during a substantial period of a workday.

SUMMARY OF THE INVENTION

One aspect of the present invention is to provide a furniture unit that is readily assembleable with a minimum of components, and is capable of releasably supporting one or more selected accessory units in a position generally along a worksurface edge with the selected accessory unit or units extending above the worksurface in positions for optimal workstation efficiency. The furniture unit includes a worksurface having a planar top surface with edges, a rail attached to the underside of the worksurface, supporting means connected to the rail for supporting the worksurface, and a plurality of accessory units adapted to equip the workstation. The furniture unit further includes means for releasably mounting one or more of the accessory units to the rail along one or more of the worksurface edges with the accessory units spaced above the worksurface, thus allowing one or more of the accessory units to be selected and positioned to personalize and equip the furniture unit for optimal efficiency.

In another aspect of the present invention, a furniture unit provides a primary worksurface, means for supporting the primary worksurface, and a drawer-like member mounted under the worksurface to one of the worksurface and means for supporting the worksurface, the drawer-like member including a front portion forming a secondary worksurface that is generally planar and spaced from the primary worksurface so that papers can be left on the drawer-like member as the drawer-like member is moved between an extended position for use and a retracted position for storage, the drawer-like member further including a rear portion that is recessed forming an enlarged storage area for papers and the like. In the preferred embodiment, the front portion is located at a predetermined height and has a suitable size so that a computer keyboard can be placed thereon at an ergonomic height with enough surface area remaining adjacent the keyboard for use as a computer mouse pad. Also, the enlarged storage area in the rear portion is recessed enough to receive and store the keyboard under the worksurface when the drawer-like member is in the retracted position.

In another aspect of the present invention, a furniture unit provides a vertically adjustable worksurface.

These and other features, advantages and objects of the present invention will be further understood and appreciated by those skilled in the art by reference to the following specification, claims and appended drawings.

DETAILED DESCRIPTION OF THE PREFERRED EMBODIMENTS

Figure 1:
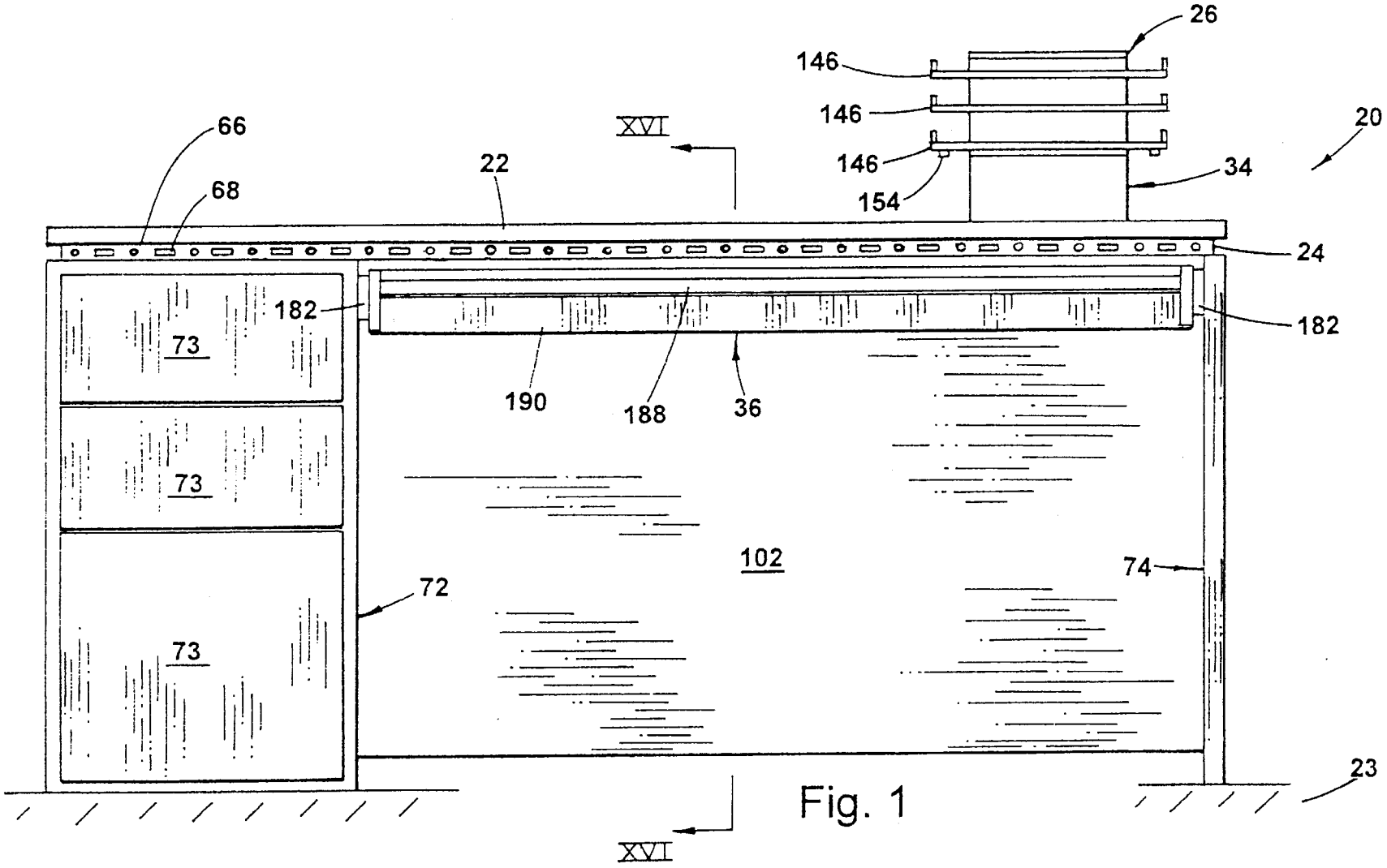
FIG. 1 is a front elevation view of furniture unit embodying the present invention.
Figure 2:
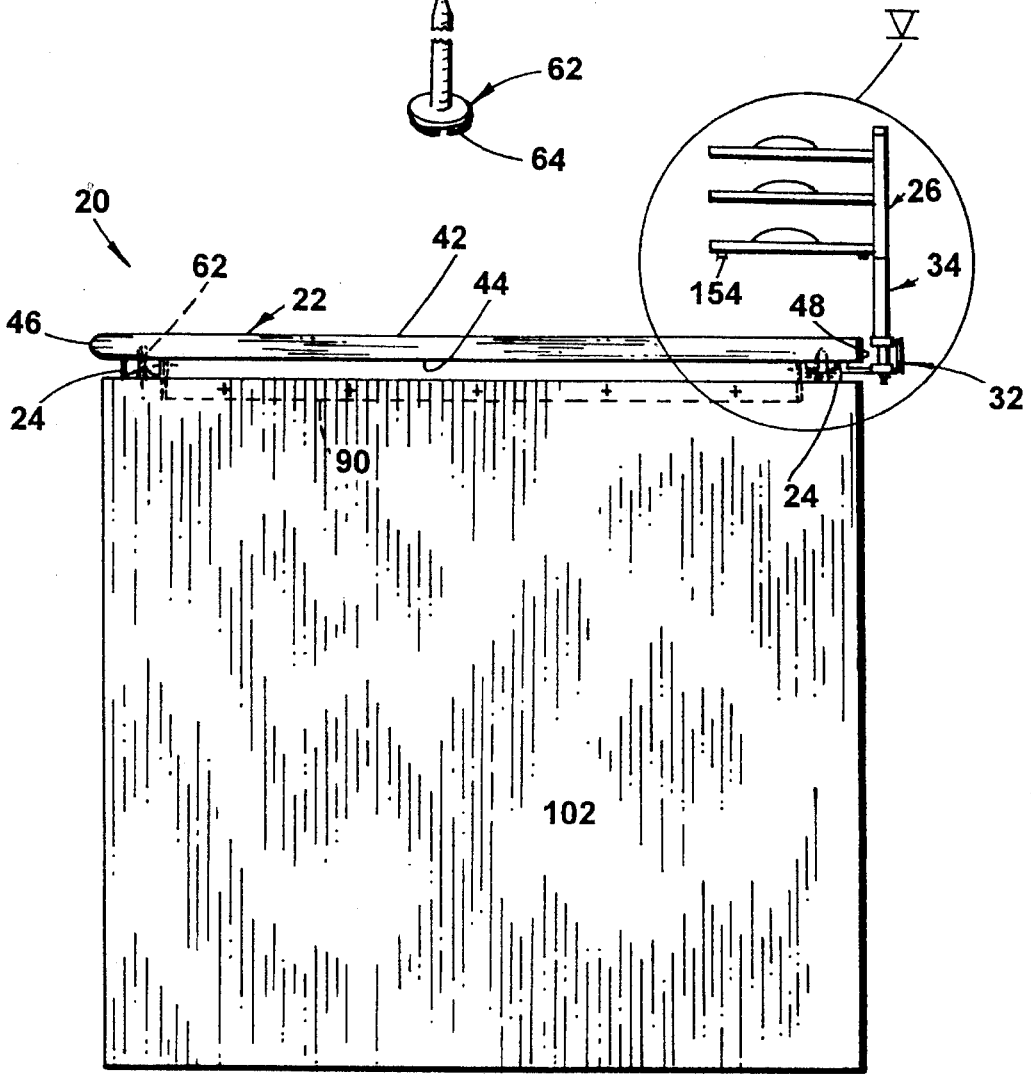
FIG. 2 is a side view of the furniture unit shown in FIG. 1.

The reference numeral 20 (FIGS. 1 and 2) generally designates a furniture unit embodying the present invention, the illustrated furniture unit 20 being substantially a uniquely configured knockdown desk that includes attachable accessories allowing it to be selectively equipped as a complete and efficient workstation for a home, an office, a manufacturing area, or the like. More particularly, furniture unit 20 includes a worksurface 22 spaced above a supporting floor surface 23 by a base 70 in FIGS. 1 and 2, a pair of rails 24 mounted under worksurface 22, and one or more accessory units 26–31 (FIGS. 1, 8–13 and 15) releasably mountable to rails 24 by brackets 32 and 33 and/or by an intermediate prong assembly or stanchion 34 so that furniture unit 20 can be readily configured to optimally equip furniture unit 20 for maximum efficiency and functionality. The accessory units are mounted in a position spaced above the worksurface to allow maximum use of the top of the worksurface 22, but at least some of the accessory units are also configured to stably rest on worksurface 22 in a free state, thus further enhancing their potential use. Further, furniture unit 20 is equipped with a drawer-like member 36 (FIGS. 16 and 17) adapted to support a computer keyboard 38 at an optimal ergonomic height when being used, while also providing a recessed area for storage of the keyboard when not being used.

More particularly, worksurface 22 (FIG. 2) is a slab-type panel having a top surface 42, bottom surface 44, and front and rear edges 46 and 48. It is contemplated that worksurface 22 can be made of a wide variety of materials, however in the preferred embodiment worksurface 22 is made of pressboard with a laminate material forming top surface 42 to provide improved appearance, durability and quality of surface finish.

Rails 24 (FIG. 2) are secured to bottom surface 44 parallel to edges 46 and 48 respectively but are spaced inwardly a short distance from edges 46 and 48. Rails 24 are spaced apart from each other and extend substantially the length of worksurface 22 so that rails 24 reinforce worksurface 22 preventing worksurface 22 from warping or sagging.

Rails 24 (FIG. 3) have a C-shaped section including sidewalls 52 and 54 interconnected by cross wall 56. Cross wall 56 includes a centrally located recess 58 extending longitudinally along rails 24, with holes 60 being located in recess 58. Screws 62 extend through holes 60 between rail sidewalls 52 and 54 into worksurface 22 with screw heads 64 resting fully in recess 58. Sidewalls 52 and 54 further include alternating holes 66 and slots 68 along their length, the purpose of which is described below.

Figure 4:
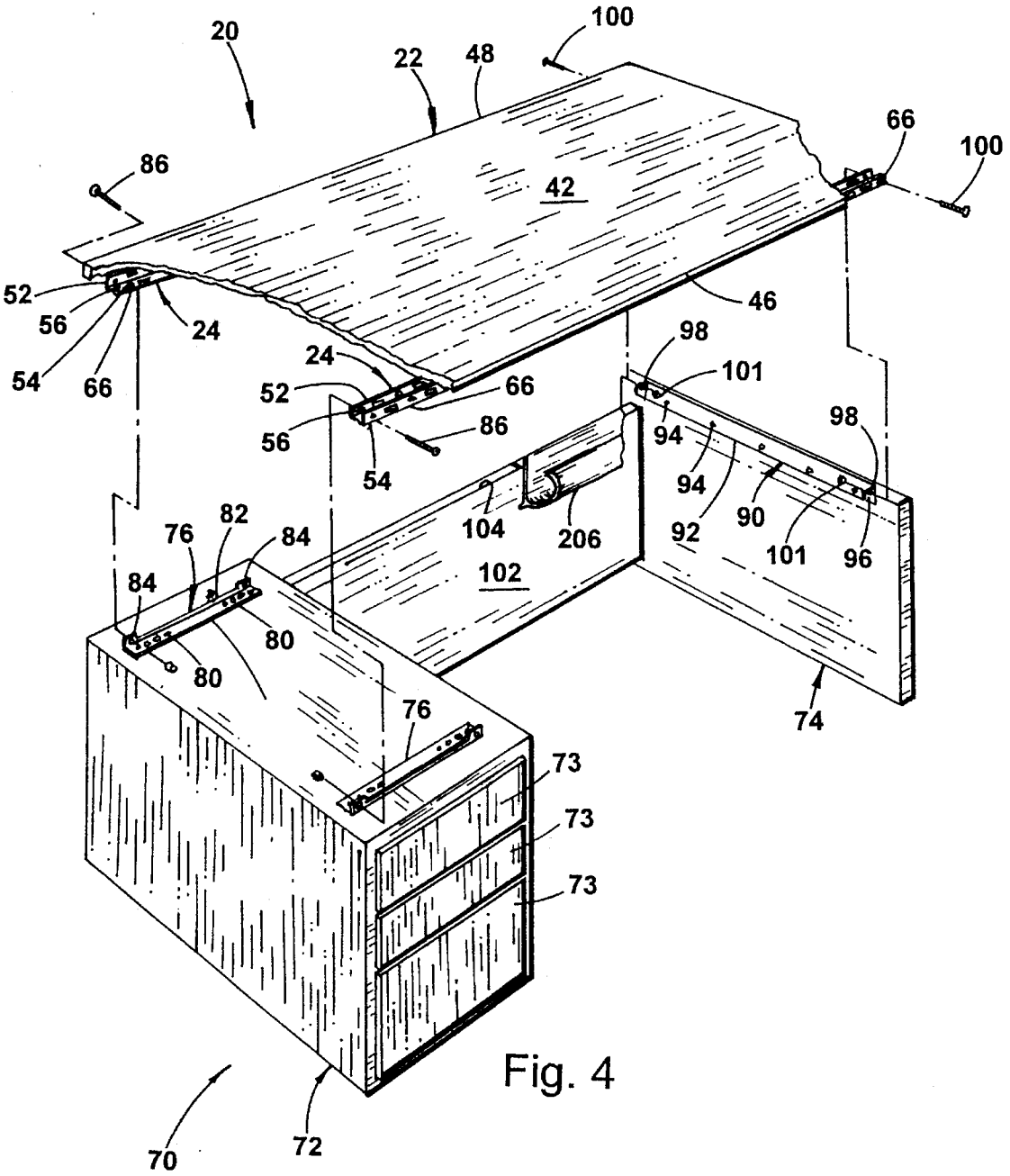
FIG. 4 is an exploded fragmentary perspective view of the furniture unit shown in FIG. 1.

Worksurface 22 (FIG. 4) is supported at a desired height by a supporting means or base 70. The illustrated base 70 includes a drawer containing pedestal 72 located at one end of worksurface 22, and an end panel 74 located at the other end of worksurface 22. Pedestal 72 includes multiple drawers 73. A pair of pedestal brackets 76 connect pedestal 72 to rails 24. Each pedestal bracket 76 is an L-shaped elongate member extending parallel to rails 24, pedestal brackets 76 each including a first flange 78 with holes 80 therein for receiving screws to attach bracket 76 to the top of pedestal 72, and further including a second flange 82 with holes 84 therein for receiving bolts 86 to secure bracket 76 to a selected one of rail sidewalls 52 and 54 on rails 24. Bolts 86 are then extended through selected rail sidewall holes 66 and bracket holes 84, one bracket 76 being secured to the inside of each of rails 24. In the embodiment shown, two pedestal brackets 76 are attached to pedestal 72 in a spaced condition so that the brackets 76 rest between rails 24 against the rail inner sidewalls, however it is contemplated that various bracket arrangements could be used.

An end panel bracket 90 (FIG. 4) connects end panel 74 to rails 24. End panel bracket 90 is an elongate member extending perpendicularly to rails 24 including a front flange 92 with holes 94 for receiving screws to attach bracket 90 to end panel 74, end panel bracket 90 further including flanged ears 96 at either end with holes 98 therein for receiving bolts 100 to secure bracket 90 to each of the rail inner sidewalls. In the illustrated example, bolts 100 extend through rail sidewall holes 66 and bracket ear holes 98 into nuts 101 to secure bracket 90 between rails 24 to both of rails 24, although alternative arrangements are contemplated.

A modesty panel 102 (FIG. 4) rigidly connects the rear of pedestal 72 and end panel 74, modesty panel 102 preventing end panel 74 from tipping unstably toward or away from a vertical position. The upper edge 104 of modesty panel 102 is spaced a distance below worksurface 22 (FIGS. 16 and 17) so that the sidewalls of rail 24 are fully exposed.

Figure 5:
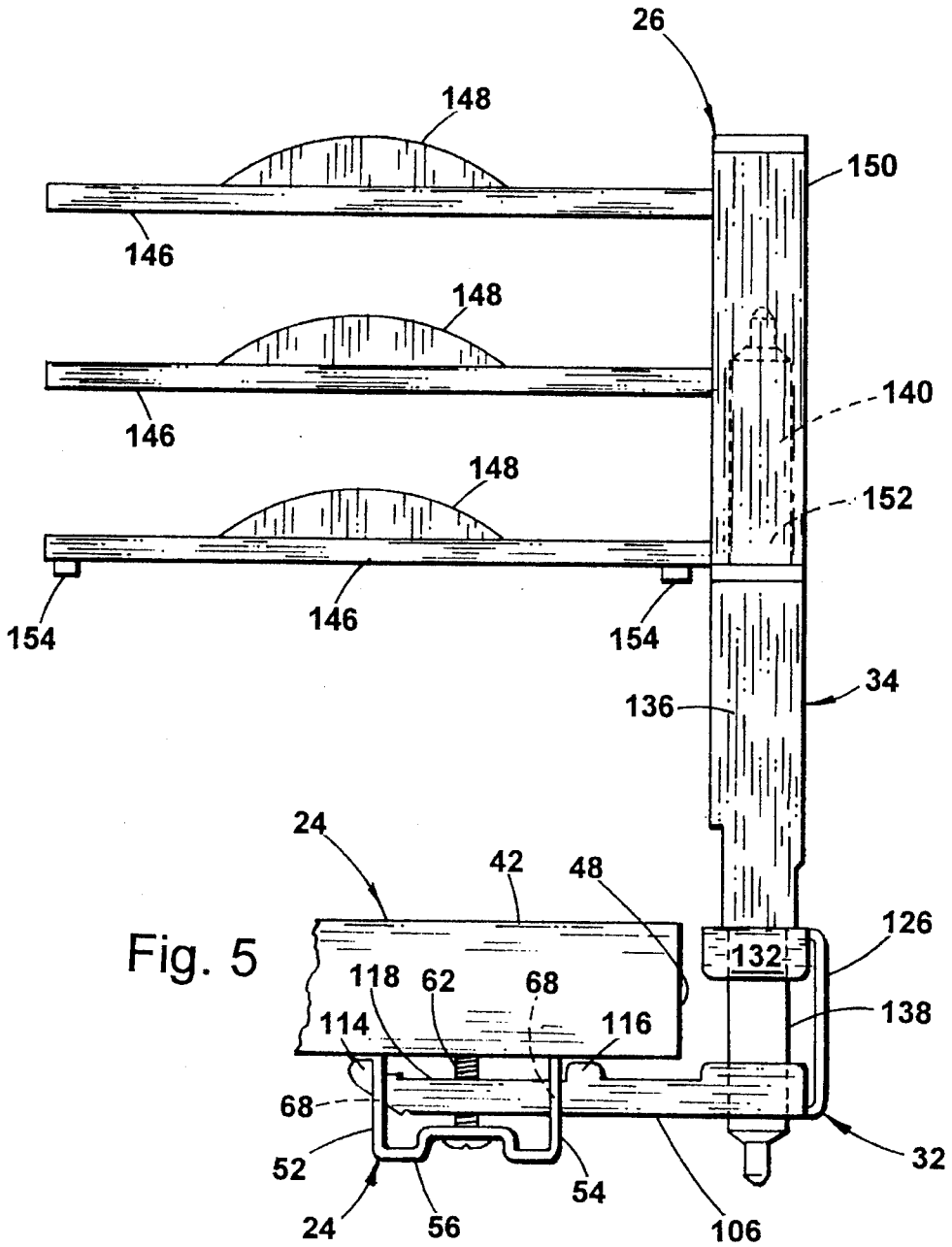
FIG. 5 is an enlarged view of the circled area labelled V in FIG. 2, the view showing the attachment of a first accessory unit to the furniture unit including a first bracket and an intermediate prong assembly.
Figure 6:
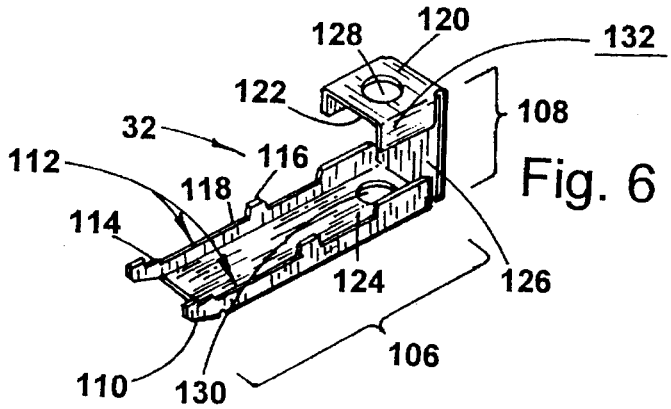
FIG. 6 is a perspective of the first bracket shown in FIG. 5 for holding accessories.

As illustrated in FIG. 5, an accessory unit 26 is attachable to one of rails 24 by use of bracket 32 and an intermediate prong assembly 34. Bracket 32 (FIG. 6) is an L-shaped bracket including a bayonet-like rail engaging end 106 and an accessory engaging end 108. Rail engaging end 106 is adapted to releasably engage slots 68 in sidewalls 52 and 54 of each rail 24. In particular, rail engaging end 106 has a U-shaped cross section with a length adapted to extend through both of sidewalls 52 and 54 and extend to a distance slightly outwardly of worksurface rear edge 48 or worksurface front edge 46. Rail engaging end 106 has a blunt but pointed end or tip 110 to facilitate extending rail engaging end 106 through slots 68, and a generally U-shaped cross section shaped to closely engage rail slots 68. The upper surface 112 of rail engaging end 106 includes a front lip 114 and a rear lip 116 with a recessed surface or notch 118 defined therebetween, lips 114 and 116 being spaced apart and adapted to securely engage rail sidewalls 52 and 54 when bracket 32 is installed in rail 24.

Accessory engaging end 108 extends upwardly from rail engaging end 106, accessory engaging end 108 extending upwardly to a top surface 120 that is equal to or above worksurface top surface 42. Accessory engaging end 108 is C-shaped having an upper and lower flange 122 and 124 interconnected by a vertically extending flange 126, upper and lower flanges 122 and 124 including aligned holes 128 and 130 adapted to securely receive intermediate prong assembly 34 as noted below. At least upper flange 122 is reinforced by flanged edges 132. When rail engaging end 106 is inserted into a selected pair of rail slots 68 and an accessory unit is placed on accessory supporting end 108, the accessory unit is supported in a cantilever fashion such that the weight of the accessory unit biases the rail engaging end 106 (and in particular notch 118) into secure engagement with rail 24.

Figure 3:
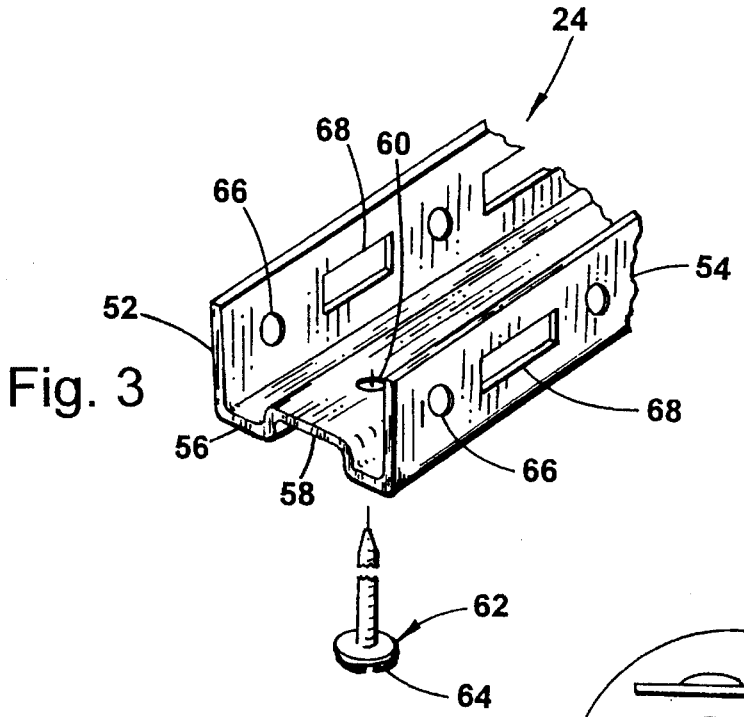
FIG. 3 is a perspective view of the rail shown in FIG. 1.
Figure 7:
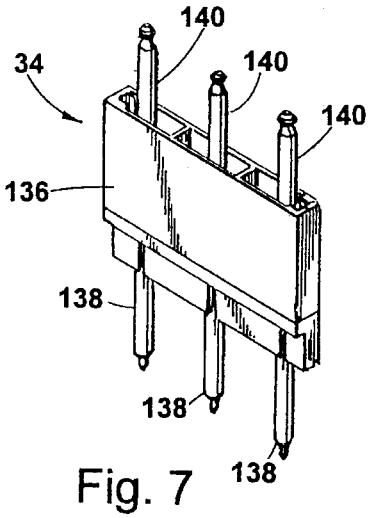
FIG. 7 is a perspective view of the intermediate prong assembly shown in FIG. 5.
Figure 13:
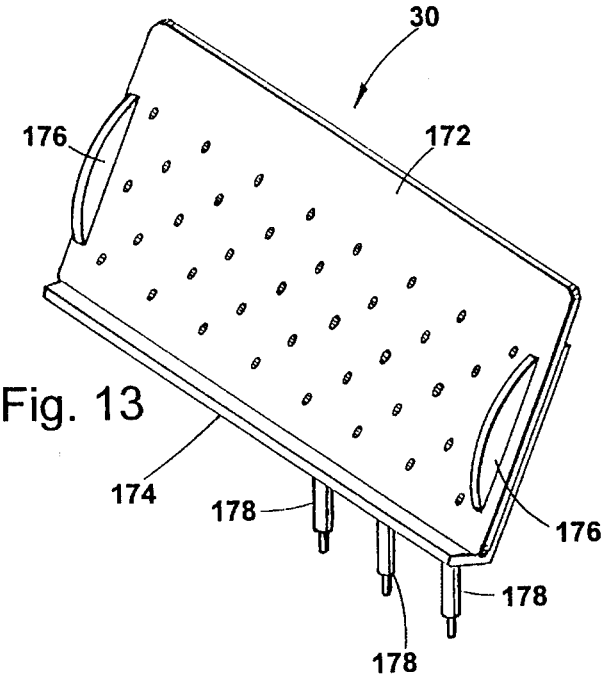
FIGS. 11–13 are perspective views of additional accessory units, the additional accessory units including integral prongs that are directly engageable with the first bracket of FIG. 6.
Figure 9:
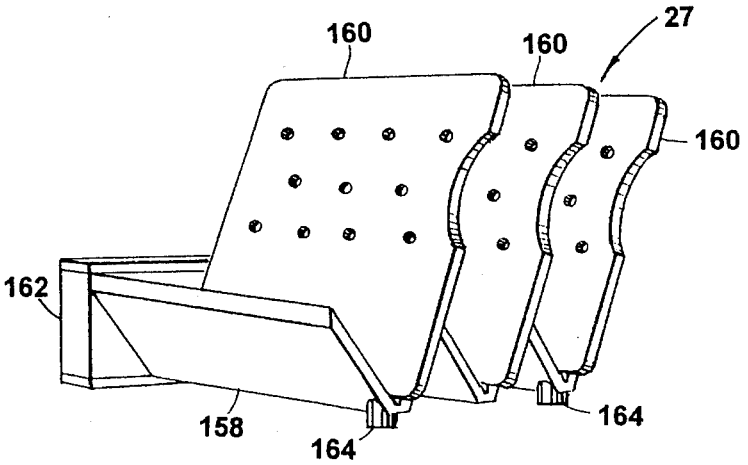
FIG. 9 is a perspective view of a second accessory unit engageable with the intermediate prong assembly of FIG. 7, the second accessory unit also being adapted to rest stably on the top of the furniture unit worksurface as a separate unit.

Intermediate prong assembly or stanchion 34 (FIG. 7) includes a rectangularly-shaped center body 136 with multiple prongs 138 extending downwardly and multiple prongs 140 extending upwardly. Each lower prong 138 is cylindrically-shaped, and is sized to securely extend into aligned holes 128 and 130 of bracket 32. Also, prongs 138 are spaced corresponding to the spacing of slots 68 on rails 24 (FIG. 3). By locating two or three brackets 32 in adjacent slots 68 of rail sidewalls 52 and 54, intermediate prong assembly 34 can be supported along worksurface edge 46 or 48 (FIGS. 2 and 5) so that center body 136 extends above worksurface top surface 42 and upper prongs 140 extend upwardly in an exposed condition. Upwardly oriented prongs 140 are similar to lower prongs 138 as far as the cylindrical shape and spacing, but are oriented upwardly to receive an accessory unit as discussed below.

The illustrated accessory unit 26 (FIG. 8) is a three-tier paper tray including three shelves 146 with edge stops 148 and a post 150. Post 150 is generally rectangularly-shaped, and includes a lower end 152 with three spaced shaped holes adapted to securely receive upper prongs 140 on intermediate prong assembly 34. Additional detail and disclosure concerning intermediate prong assembly 34, and related mateable accessories can be found in U.S. Pat. No. 5,094,174 to Grund et al. issued Mar. 10, 1992 entitled "MODULAR FURNITURE", the entire contents of which are incorporated hereinafter by reference. Notably, accessory unit 26 includes bumpers or feet 154 located under the corners of lowermost shelf 146 so that accessory unit 26 can also stably rest on worksurface 22 in a free condition like traditional accessory units.

Figure 10:
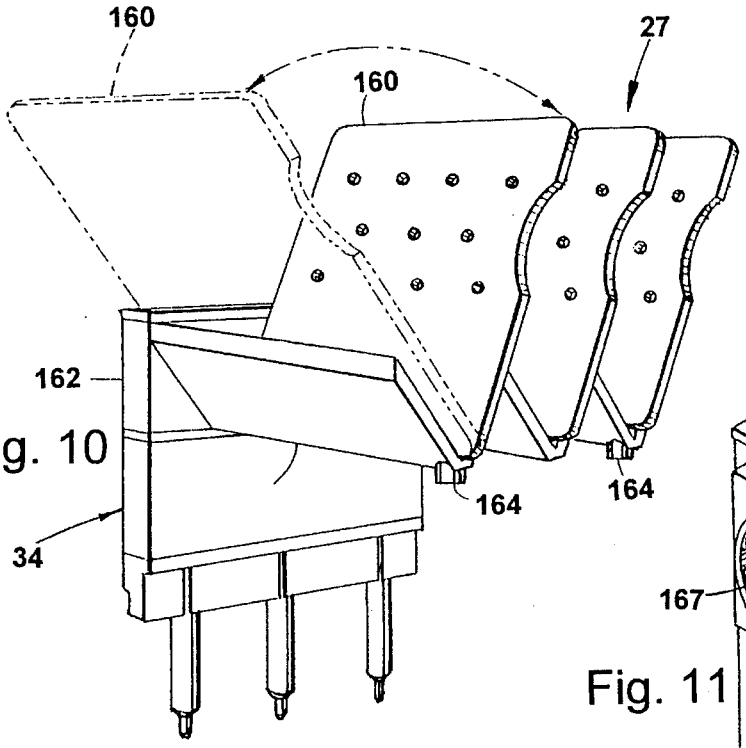
FIG. 10 is a perspective view of the second accessory unit of FIG. 9 shown as installed on the intermediate prong assembly of FIG. 7.
Figure 11:
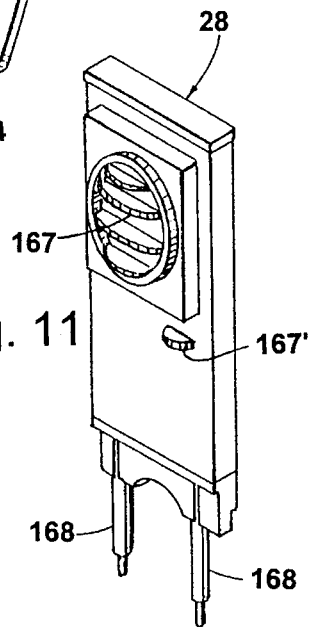
Figure 12:
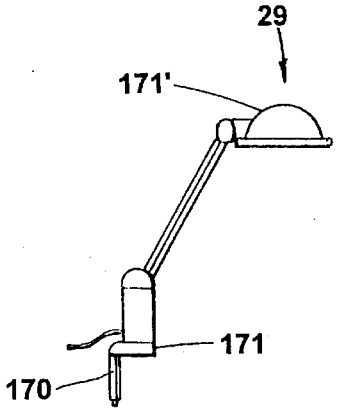
Figure 8:
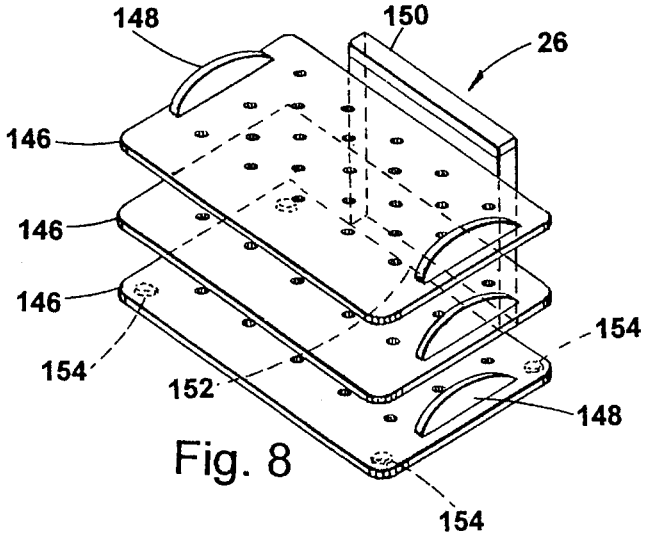
FIG. 8 is a perspective view of the first accessory unit shown in FIG. 5, the accessory unit being engageable with the intermediate prong assembly of FIG. 7 and also being adapted to rest stably on the top of the furniture unit worksurface as a separate unit.
Figure 15:
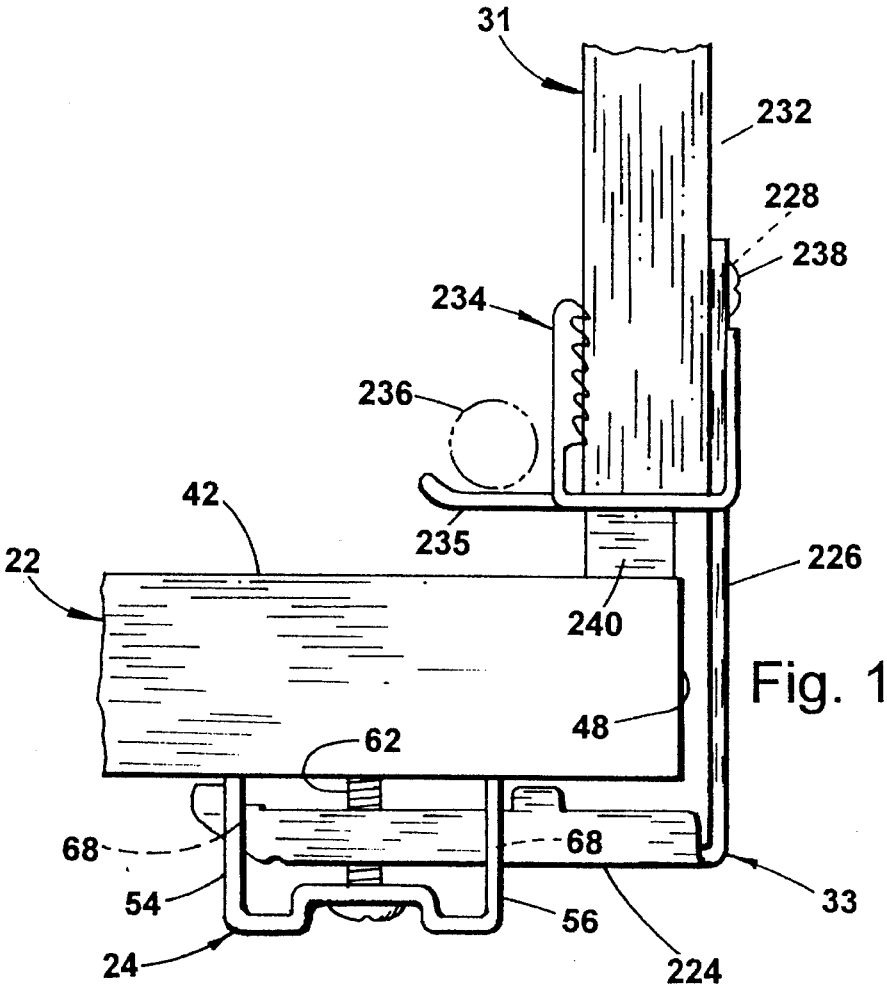
FIG. 15 is an enlarged view similar to FIG. 5, but showing the second bracket attached to the furniture unit with an erasable noteboard attached to the second bracket.

Accessory unit 27 (FIG. 9) is similar to accessory unit 26 as far as being positionable in a free state on worksurface 22 or positionable on intermediate prong assembly 34 and on brackets 32. More particularly, accessory unit 27 includes a "W" shelf 158, and flip-flop dividers 160 pivotally connected to "W" shelf 158, dividers 160 being movable between right and left positions (FIG. 10). By moving dividers 160 between the right and left positions, various files held in dividers 160 can be opened and reviewed, thus eliminating the need to pull the file every time it must be accessed. Accessory unit 27 includes a center body 162 connected to the rear of "W" shelf 158. Center body 162 is similar to accessory unit post 150, and includes spaced shaped holes on the lower side of center body 162 for receiving upwardly extending upper prongs 140 of intermediate prong assembly 34. As shown in FIG. 10, accessory unit 27 is mountable to intermediate prong assembly 34, which in turn is readily mountable onto one or more brackets 32. Notably, bumpers 164 are mounted to the lowermost portions of "W" shelf 158 so that accessory unit 27 can also stably rest on worksurface 22 in a free condition without damaging worksurface 22.

Accessory units 28–30 include additional features for equipping furniture unit 20. Accessory unit 28 (FIG. 11) is an electrically operated fan with blower 167 and switch 167'. Accessory unit 28 includes a pair of downwardly extending prongs 168 for directly engaging a pair of brackets 32. Accessory unit 29 (FIG. 12) is an adjustable-height light fixture with a base 171 including downwardly extending prongs 170 also adapted to engage a pair of brackets 32, and an adjustable height light fixture portion 171'. Notably, prongs 168 and 170 are integral with accessory units 28 and 29.

Accessory 30 (FIG. 13) is an angled paper tray particularly adapted to attach in a forwardly facing position along worksurface front edge 46 for supporting papers or notes such as while a computer is being used on drawer 36, such as the computer and computer keyboard 38 discussed below. Angled paper tray 30 includes an angled rear paper support panel 172, a lower lip 174 and side paper stops 176 for retaining a sheet of paper (not shown) on the tray. Prongs 178 are mounted to the back of angled rear paper support panel 172 and extend downwardly for engaging brackets 32.

Figure 14:
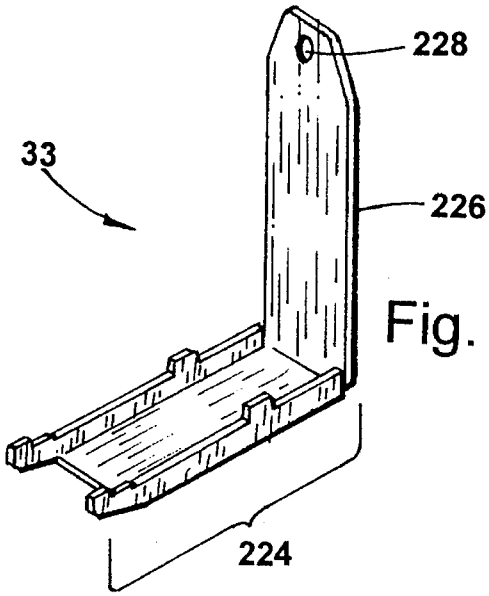
FIG. 14 is a perspective view of a second bracket for holding accessory units.

It is contemplated that a number of different brackets could be configured to engage rail 24. For example, a second bracket 33 (FIGS. 14 and 15) includes a rail engaging end 224 that is virtually identical to rail engaging end 106 of bracket 32, rail engaging end 224 being also adapted to securely releasably engage rail slots 68 in rail sidewalls 52 and 54. Extending upwardly from the outer end of rail engaging end 224 is an accessory engaging end 226 that is substantially a vertical tab-like flange with one or more attachment holes 228 therein. An erasable noteboard 31 (FIG. 15) is attached to accessory engaging end 226, noteboard 31 including a panel-like body 232 with a frame 234 extending around the perimeter of body 232, frame 234 having a C-shaped cross section. Noteboard 31 is secured to bracket 33 by screws 238 that extend through bracket attachment holes 228 into noteboard body 232 and/or frame 234. If necessary, a stabilizing bumper 240 can be attached to the lower portion of frame 234, bumper 240 engagingly resting on top surface 42 of worksurface 22. Optimally, the lower portion of frame 234 includes a shelf 235 for holding erasable marking pens 236, erasers (not shown), and the like.

Figure 16:
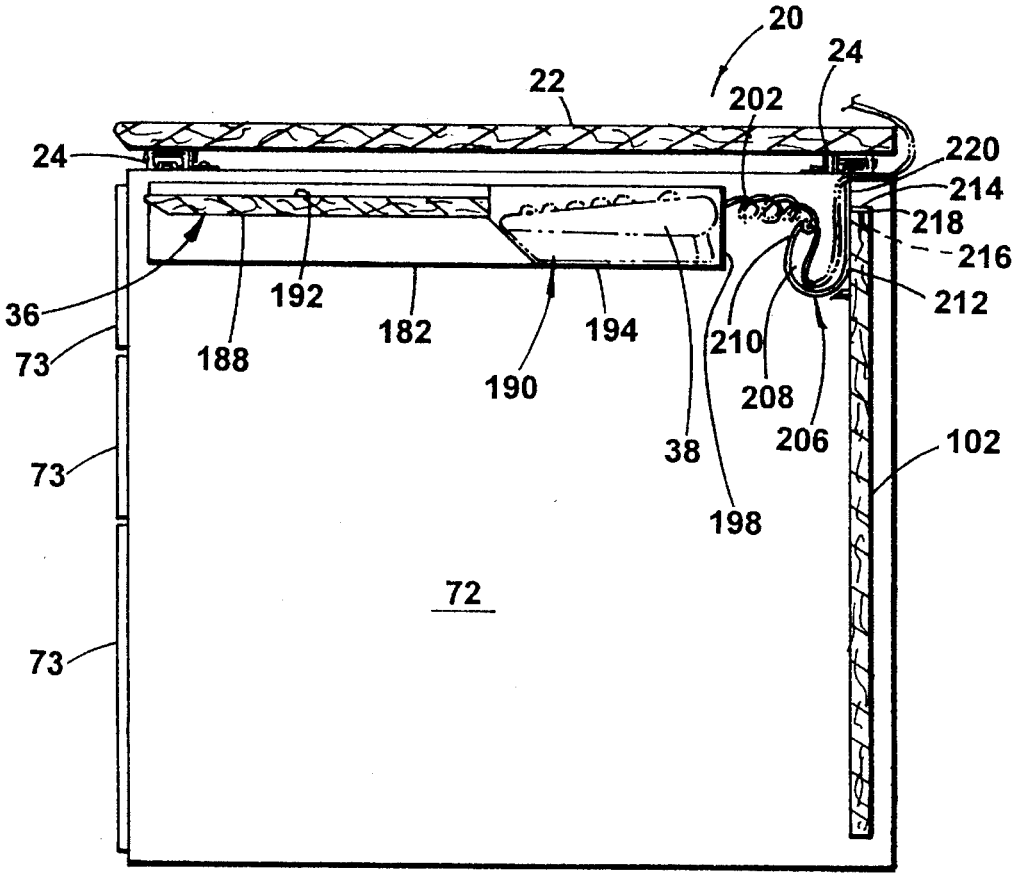
FIG. 16 is a side cross-sectional view taken along the lines XVI—XVI in FIG. 1, the view showing the drawer-like member in a retracted position.

Drawer-like member 36 (FIGS. 16 and 17) is supported between pedestal 72 and end panel 74 on a pair of conventional drawer glide supports 182 that allow drawer-like member 36 to be moved between an extended position for use (FIG. 17) and a retracted position for storage (FIG. 16). Drawer-like glide supports 182 include a pair of tracks attached to the inside surfaces of pedestal 72 and end panel 74 under worksurface 22, and further include a pair of slides that extend laterally from the sides of drawer-like member 36 operably into the tracks.

Drawer-like member 36 includes a slab-like front portion 188 made of press board or the like, and a rear portion 190 made of sheet metal attached to the rear edge of front portion 188. Front portion 188 forms a second auxiliary worksurface when extended. Notably, the top surface 192 of front portion 188 is spaced about one inch below worksurface 22 so that papers can be left on secondary auxiliary worksurface front portion 188 when drawer-like member 36 is moved to a retracted position for storage. Top surface 192 of front portion 188 is an enlarged planar area that can be used to support keyboard 38 at an ergonomic height so that keyboard 38 can be easily typed on, top surface 192 also being large enough to support a mouse pad to one side of keyboard 38 during use.

Figure 17:
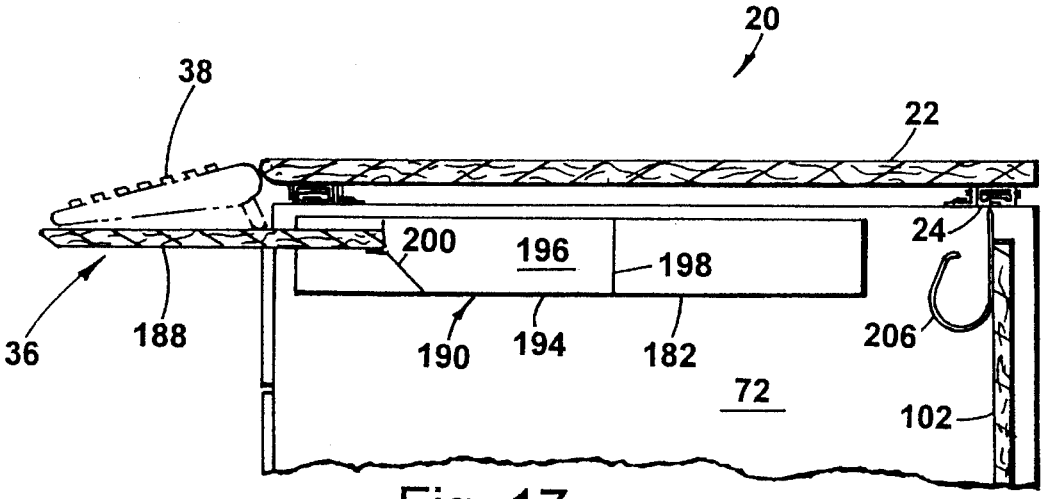
FIG. 17 is a view similar to FIG. 16 but showing the drawer-like member in an extended position.

Rear portion 190 (FIG. 17) includes a depressed floor 194, sides 196, a half height rear wall 198 and a front flange 200 attached to the rear edge of front portion 188. Rear portion 190 forms a pocket or recessed area to store keyboard 38, a computer mouse (not shown), and related papers, with communication cables 202 (FIG. 16) extending from keyboard 38 over rear wall 198 into a channel-like extrusion 206 as discussed below. Notably, drawer-like member 36 can be extended far enough forward so that keyboard 38 can be easily moved between the storage position in rear portion 190 (FIG. 16) and a use position on front portion 188 (FIG. 17).

An elongate extrusion 206 (FIG. 16) extends along the inside of modesty panel 102 along the upper edge thereof under worksurface 22, extrusion 206 forming a channel 208 for carrying wires or cables therein. Channel 208 is C-shaped, and includes a front wall 210 and a rear wall 212, with front wall 210 being tipped toward rear wall 212 to facilitate retaining wires or cables in channel 108. Notably, the edge of front wall 210 forms a surface that is releasably engageable by the coiled spirally-shaped cable often used to connect keyboard 38 to the computer (not shown). A flange 214 extends rearwardly from rear wall 212 and includes protrusions 216 that are adapted to releasably frictionally engage holes in the upper edge 218 of modesty panel 102. A second flexible flange or wall 220 extends upwardly from rear wall 212 to close off the space between rail 24 on worksurface 22 and modesty panel 102. Flexible flange 220 is resilient so that wires can be routed over flange 220 under rail 24 and around worksurface edge 48 (FIG. 16) into accessory units such as fan 28 or light 29, or onto worksurface 22 for energizing other units such as a computer and computer display terminal (not shown).

Figure 18:
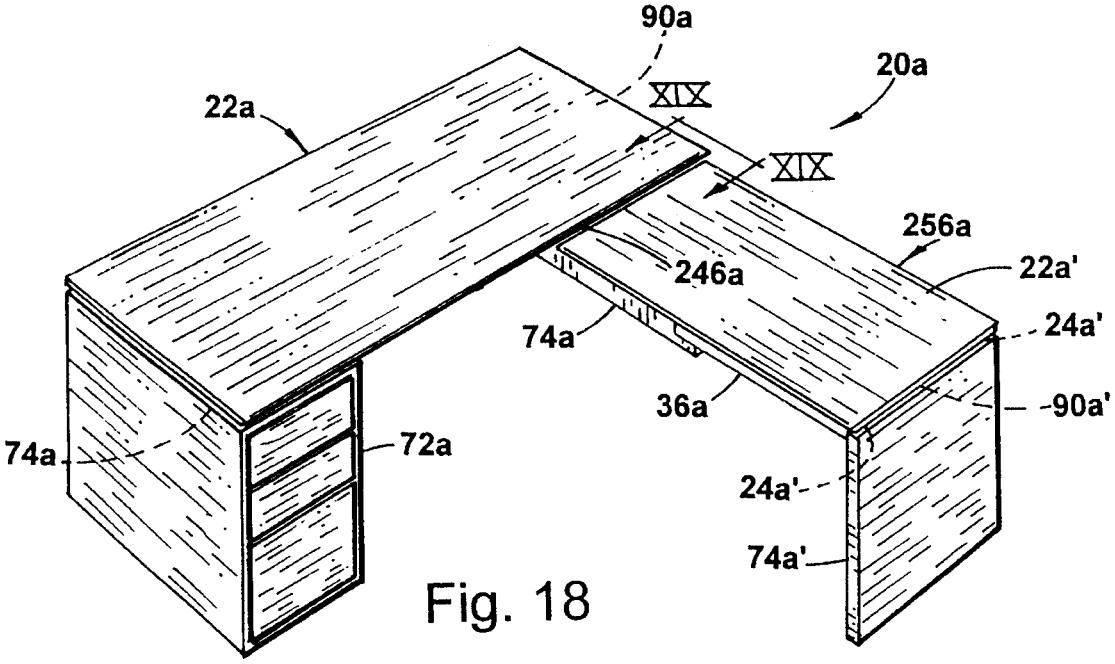
FIG. 18 is a perspective view showing a modified furniture unit and return embodying the present invention.

A modified version 20A of furniture unit 20 is shown in FIG. 18, version 20A also embodying the present invention. Components of furniture unit 20A that are similar to furniture unit 20 are shown with the same number, but with the addition of the letters A. Subsequent modifications are similarly numbered, but with additions of the letter B or C.

Furniture unit 20A (FIG. 18) includes a worksurface 22A and a return 256A, return 256A including a return worksurface 22A' spaced below worksurface 22A and extending laterally and further including return rails 24A' mounted under return worksurface 22A' to reinforce same. Worksurface 22A and return worksurface 22A' are supported by a pedestal 72A and two end panels 74A and 74A'. Pedestal 72A is attached to rails 24A located on the underside of worksurface 22A by pedestal brackets 76A, and end panel 74A is also attached to rails 24A at an opposite end by an end panel bracket 90A, brackets 76A and 90A being similar to brackets 76 and 90 as noted above. Return worksurface 22A' is supported at one end by end panel 74A' which includes an end panel bracket 90A' that attaches to rails 24A', and at the other end by a Z-shaped bracket 246A that attaches to rail 24A and return rail 24A' as discussed below.

Figure 19:
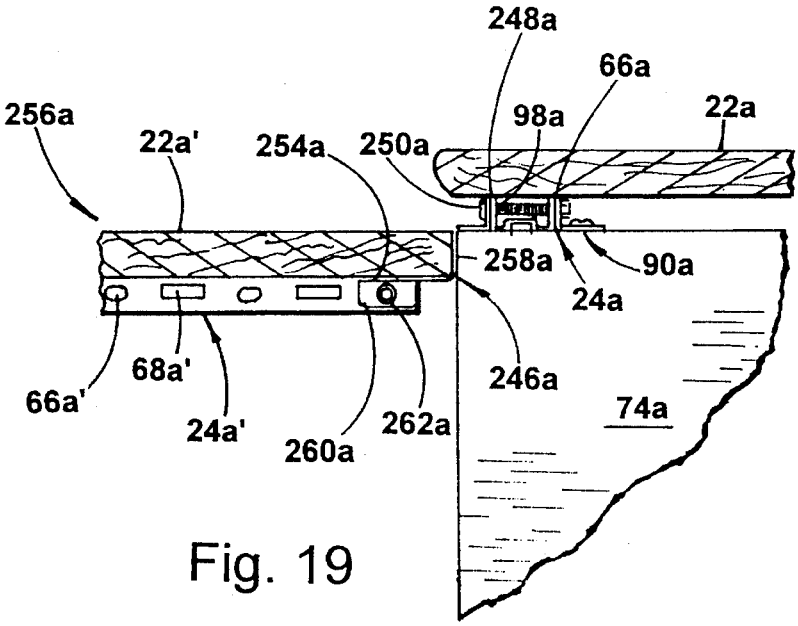
FIG. 19 is a fragmentary cross-sectional view taken along the lines XIX—XIX in FIG. 18.

More particularly, Z-shaped return bracket 246A (FIG. 19) is attached to the outer side of front rail 24A. Return bracket 246A includes an upper flange 248A for attaching to rail 24A by use of bolts 250A that extend through holes in first flange 248A and through holes 66A in rails 24A. At the end of worksurface 22A adjacent end panel 74A, bolt 250A also extends through the hole 98A in end panel bracket 90A, though it is noted that separate holes 66A could be used. Return bracket 246A also includes a lower flange 254A that attaches to return rails 24A' and supports return worksurface 22A', flange 254A being connected to upper flange 248A by an L-shaped connecting flange 258A. Lower flange 254A includes spaced apart flanged ears 260A including holes 262A for connecting to return rails 24A'. In the illustrated example, bracket 246A positions worksurface 22A' at the same height as the top of pedestal 72A and the top of end panel 74A', although various heights could be achieved by modifying bracket 246A.

Figure 20:
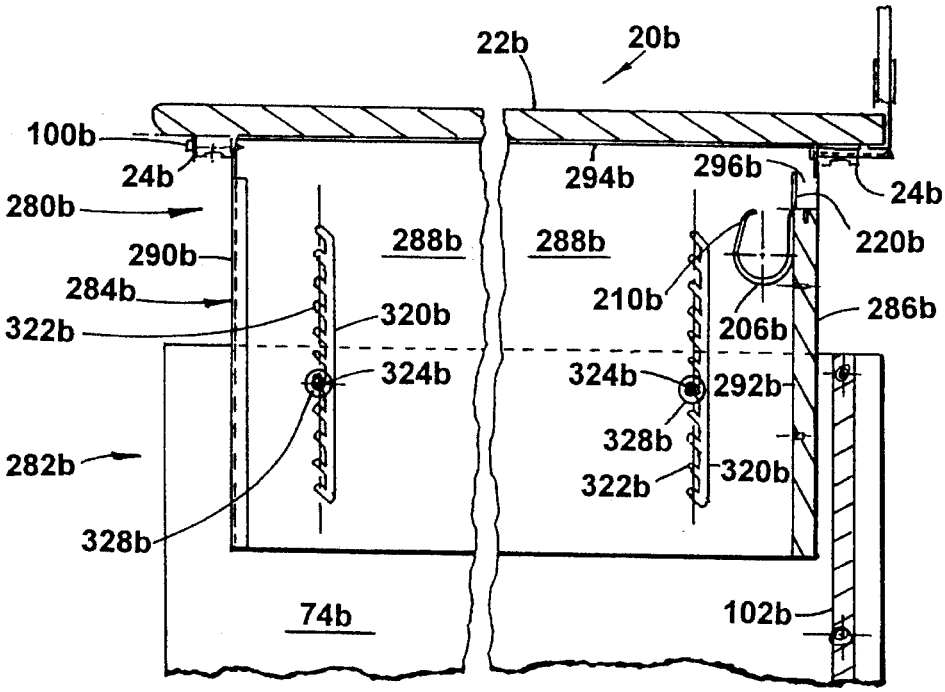
FIG. 20 is a fragmentary cross-sectional side elevational view of a second modified furniture unit, the modified furniture unit having a vertically adjustable worksurface.

Still another modified furniture unit 20B embodying the present invention is shown in FIG. 20. Furniture unit 20B is substantially a desk having a vertically adjustable worksurface 22B that can be adjusted to an optimal height such as for a wheelchair-bound person or for persons of different size. Furniture unit 20B includes a movable upper subassembly 280B and a stationary lower subassembly 282B. Lower subassembly 282B includes a pair of end panels 74B interconnected to a stationary modesty panel 102B in a C-shaped arrangement adapted to closely receive upper subassembly 282B. Upper subassembly 280B includes a worksurface 22B and a pair of rails 24B connected to the underside of worksurface 22B. A pair of adjusting brackets 284B (only one of which is shown) are joined with a movable modesty panel 286B in a C-shaped arrangement and are attached to rails 24B to form upper assembly 280B, with brackets 284B and movable modesty panel 286B being slideably received within the pair of end panels 74B and stationary modesty panel 102B, respectively. Notably, movable modesty panel 286B is spaced below worksurface 22B so that an extrusion 206B can be secured thereto. Right and left adjusting brackets 284B are mirror images of each other and hence only bracket 284B is described hereinafter.

Figure 22:
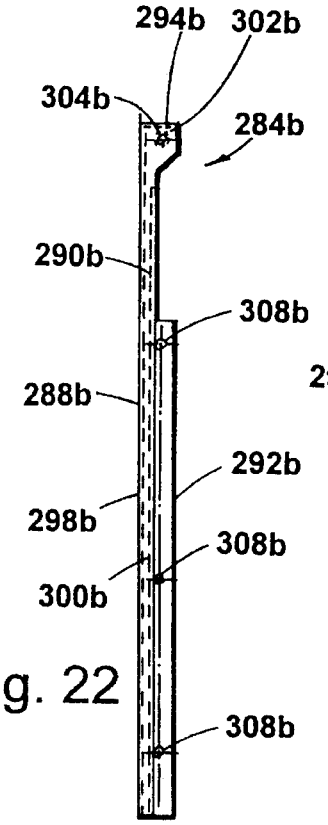
FIG. 22 is a front view of the mounting bracket shown in FIG. 20.
Figure 21:
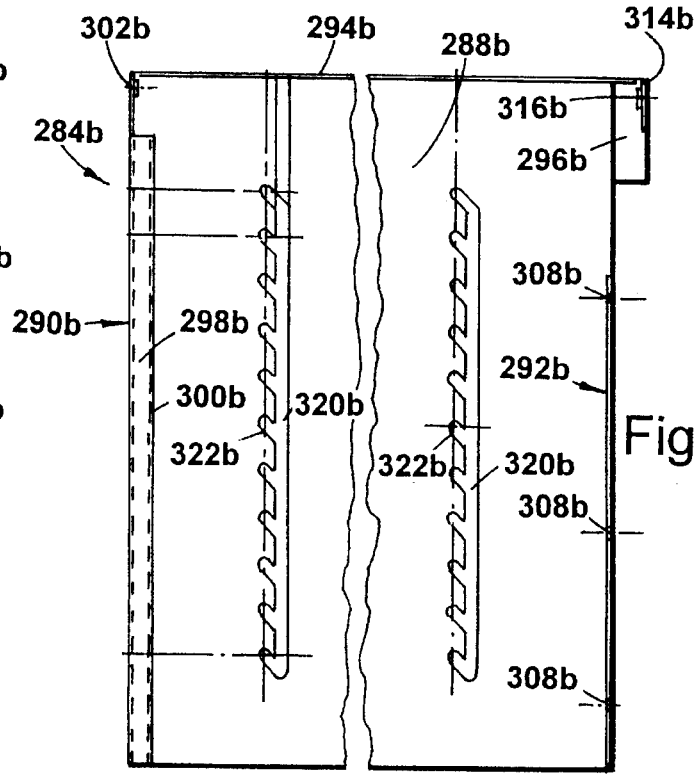
FIG. 21 is a side elevational view of the mounting bracket permitting the vertical adjustment of the worksurface of the second modified furniture unit shown in FIG. 20.

Adjusting bracket 284B (FIGS. 21 and 22) is a sheet-like member formed out of sheet metal and includes a planar central portion 288B with a plurality of flanges 290B, 292B, 294B and 296B located around part of the perimeter of central portion 288B. First flange 290B is located along the forward edge of bracket 284B and includes a first leg 298B that extends perpendicularly from central portion 288B and stiffens same, and further includes a second leg 300B that extends inwardly perpendicularly from first leg 298B. A flange-like ear 302B extends from the top of first leg 298B, flange-like ear 302B including a hole 304B for receiving a bolt 100B (FIG. 20) to attach bracket 284B to the forwardmost rail 24B.

Second flange 292B (FIG. 21 ) is located at the rear edge of central portion 288B opposite first flange 290B. Second flange 292B extends perpendicularly from central portion 288B stiffening central portion 288B, and includes holes 308B for receiving screws 310B to attach bracket 284B to movable modesty panel 286B. Third flange 294B is located along the top of central portion 288B, and generally stiffens central portion 288B from front to rear. Third flange 294B generally abuts the underside of worksurface 22B (FIG. 20), but may or may not be secured thereto, depending on the stiffness required. Fourth flange 296B is a tab-like flange that extends rearwardly from an upper rear corner of central portion 288B. Fourth flange 296B includes a perpendicularly extending ear 314B that includes holes 316B for securing a bolt 100B to attach bracket 284B to rearwardmost rail 24B. Fourth flange 296B spaces rear flange 292B forwardly (FIG. 20) so that movable modesty panel 286B is spaced forwardly of rear rail 24B and stationary modesty panel 102B. Notably, upper flange 294B extends partially onto flange 296B to stiffen same.

Central portion 288B (FIG. 21) of adjustable bracket 284B includes a pair of parallel vertical main slots 320B, with a plurality of finger-like slots 322B extending upwardly at an angle to main slot 320B. With upper subassembly 280B positioned within lower subassembly 282B (FIG. 20), a fastener or bolt 324B is loosely extended through each of slots 320B. Optimally, bolts 324B are threaded into internally threaded brass inserts (not shown) which are press-fit in end panels 74B, the inserts providing increased durability by reducing the likelihood of stripping the threads as bolts 324B are tightened. Bolts 324B each include a washer 328B on the bolt head, washer 324B being flexible and/or resilient and thus adapted to grip the material in brackets 284B forming slots 320B/322B as bolts 324B are tightened. It is contemplated that the head of bolts 324B could include a hand twist knob to facilitate loosening/tightening same (without the need for tools).

To vertically adjust worksurface 22B, bolts 324 are loosened, and a pair of operators lift upper subassembly 280B to the desired height. Once upper subassembly 280B is lifted to the desired height, upper assembly 280B is shifted rearwardly slightly, thus causing the shaft of bolts 324B to slip into a selected pair of finger-like slots 322B. Bolts 324B are then tightened, thus securing upper subassembly 280B and in particular worksurface 22B at the desired height. Notably, it is contemplated that different means for securing upper subassembly 280B to lower subassembly 282B can be used, such as by utilizing a pair of vertically spaced apart bolts 324B (not shown) extended into a single main slot 320B for engaging separate finger-like slots 322B. However, the vertical spacing of bolts 324B would limit the vertical adjustability of upper subassembly 280B, and thus may not be as desirable. It is contemplated that the illustrated worksurface 22B will be adjustable in height from about 22 to 32 inches, though various heights are possible.

Figure 23:
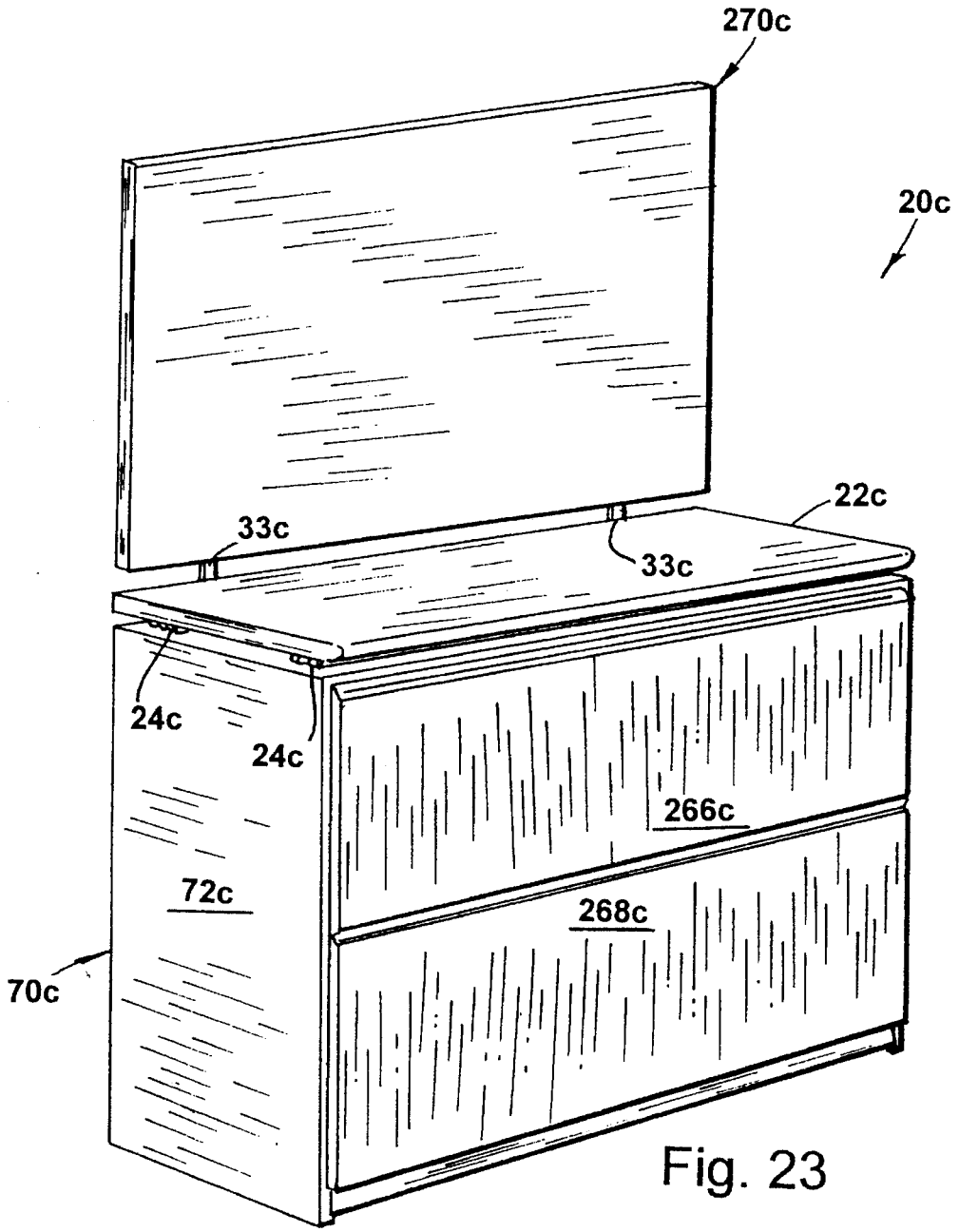
FIG. 23 is a perspective view of a cabinet-like furniture unit embodying the present invention, the furniture unit including a privacy screen.

Another modified furniture unit 20C (FIG. 23) embodying the present invention is substantially a cabinet with drawers, and includes a slab-type panel 22C with a pair of spaced rails 24C attached underneath panel 22C, and a base unit 70C. Base unit 70C includes an elongated pedestal 72C including filing drawers 266C and 268C. Furniture unit 20C does not include a knee space allowing it to be used as a desk per se, however furniture unit or cabinet 20C can be positioned near to one or more of the other furniture units disclosed herein such that any of accessory units 26–31 or other accessory units can be attached to furniture unit 20C for optimizing efficient use of a workstation. In the embodiments shown, a privacy screen 270C is attached to rails 24C on brackets 33C, thus assisting in defining a particular workstation.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A furniture unit for workstations, comprising:

a worksurface including a top surface, a bottom surface, and marginal edges extending therebetween;

a rail attached to the bottom surface of said worksurface, and extending along at least one of said marginal edges, said rail including a plurality of first apertures;

a support connected to said rail for supporting said worksurface at a predetermined height above a floor surface;

a plurality of accessory units configured for use on said workstation; and means for releasably selectively mounting at least one of said accessory units to said rail along the one marginal edge of said worksurface, and positioning said one accessory unit above said worksurface, said means for releasably selectively mounting including a bracket with a bayonet-like leg releasably engageable with one or more of said first apertures whereby said one accessory unit can be located to personalize and equip said furniture unit.

2. A furniture unit as defined in claim 1 wherein at least some of said plurality of accessory units are also adapted to rest in a free state directly on the worksurface.

3. A furniture unit as defined in claim 1 wherein said rail acts as a standoff between said worksurface and said supporting means creating a space therebetween, said first apertures being positioned in said space for ready access.

4. A furniture unit as defined in claim 3 wherein said bracket includes an accessory unit supporting end that is supported in a cantilevered fashion by said bayonet-like leg, and said accessory units include means for stably engaging said accessory unit supporting end.

5. A furniture unit as defined in claim 4 wherein said rail includes second apertures for attaching said supporting means to said rail, said second apertures being spaced longitudinally along said rail with said first apertures.

6. A furniture unit as defined in claim 5 wherein said rail is U-shaped and includes a pair of sidewalls, and said first and second apertures are located along the length of said rail in both of said sidewalls.

7. A furniture unit as defined in claim 1 wherein said bracket includes a portion extending above and below said top surface.

8. A furniture unit as defined in claim 1 wherein a pair of identical brackets are used to support a particular one of said accessory units.

9. A furniture unit as defined in claim 1 wherein said selected accessory units are spaced above and over said worksurface when positioned on said bracket.

10. A furniture unit as defined in claim 9 including a bumper resting on said worksurface supportingly under said selected accessory units for supporting and stabilizing said selected accessory unit.

11. A furniture unit as defined in claim 1 including a drawer-like member mounted under said worksurface, said drawer-like member including a front portion forming a secondary worksurface that is generally planar and is spaced from said worksurface so that papers can be left thereon as said drawer-like member is moved between an extended position for use and a retracted position, said drawer-like member further including a rear portion that is recessed forming an enlarged storage area for papers and the like.

12. A furniture unit as defined in claim 11 wherein said first portion is located at a predetermined height and has a suitable size so that a computer keyboard can be placed thereon at an ergonomic height for typing, said front portion size being sufficiently large for supporting the computer keyboard with an adjacent computer mouse pad, and said rear portion is recessed with enough size to receive the keyboard for storage of the keyboard under the worksurface when the drawer-like member is in the retracted position.

13. A furniture unit as defined in claim 12 wherein said front portion is a slab-type panel, and said rearward portion is a sheet metal formed drawer-like part attached to the rear said slab-type panel.

14. A furniture unit as defined in claim 1 wherein said rail has a U-shaped cross section and includes opposing sidewalls and a cross wall interconnecting said sidewalls, said opposing sidewalls including aligned pairs of said first apertures for connecting said supporting means thereto, and said means for releasably mounting said accessory units to said first apertures includes a bayonet-like leg for releasably engaging said aligned pairs of said first apertures.

15. A furniture unit as defined in claim 1 wherein said means for releasably mounting said one or more accessory units includes a bracket having an accessory unit engaging end including upwardly oriented prong receiving apertures, said prong receiving apertures being positioned in an accessible location relative to said worksurface and defining means for releasably securing a selected one of said accessory units.

16. A furniture unit as defined in claim 15 wherein said means for releasably securing includes an intermediate prong assembly having downwardly oriented prongs spaced for engagement with said upwardly oriented apertures, and further including an upper portion adapted to releasably engage one of said accessory units whereby said accessory unit can be selectively placed either on said worksurface or on said intermediate prong assembly and said bracket in a position spaced above said top of said worksurface.

17. A furniture unit as defined in claim 16 wherein said intermediate prong assembly upper portion includes upwardly oriented prongs, and several of said accessory units are adapted to releasably securely engage said upwardly oriented prongs.

18. A furniture unit as defined in claim 1 wherein said supporting means includes a base and further includes bracket means connected to said rail and operably connected to said base for semipermanently vertically adjusting the height of said worksurface, whereby the height of said worksurface is adjustable to an optimal height for a given user.

19. A furniture unit as defined in claim 18 wherein said bracket means includes a bracket attached to said rail, said bracket having at least one elongate vertical slot with multiple finger-like slots extending laterally at an angle from said vertical slot, and said supporting means includes at least one fastener extending through one of said slots into said base, whereby said worksurface can be raised to a desired position with said fastener loosely engaging a selected one of said finger-like slots to hold said worksurface at a selected desired height, and said fastener can be tightened into said base to securely semipermanently hold said worksurface at said desired position.

20. A furniture unit as defined in claim 1 including a pair of said rails attached to said worksurface proximate the edges of said worksurface so that said selected accessory units can be positioned along more than one of said worksurface edges.

21. A furniture unit for workstations, comprising:

a worksurface including atop surface, a bottom surface, and marginal edges extending therebetween;

a U-shaped rail attached to the bottom surface of said worksurface, and extending along at least one of said marginal edges, said rail including opposing sidewalls and a cross wall interconnecting said sidewalls, and further including a plurality of aligned pairs of first apertures in said opposing sidewalls;

supporting means connected to said rail for supporting said worksurface at a predetermined height;

a plurality of accessory units configured for use on said workstation;

brackets including a bayonet-like leg for releasably engaging said aligned pairs of first apertures, said brackets being configured to releasably selectively mount at least one of said accessory units to said rail along the one marginal edge of said worksurface, and position said one accessory unit above said worksurface; and said cross wall being spaced from said worksurface thus creating a space defined by said sidewalls, said cross wall and the underside of said worksurface, said space being useful for receiving said means for releasably mounting said accessory unit, said cross wall including a depression extending longitudinally in said cross wall for receiving a fastener head, and further including holes in said depression for receiving a fastener shaft, whereby fasteners can be extended through one or more of said holes and into said worksurface for retaining said rail to said worksurface with the fastener heads being located in the depression in the cross wall in a position where the fastener heads do not interfere with resting the rail cross wall on the supporting means.

22. A furniture unit for workstations, comprising:

a worksurface including a top surface, a bottom surface, and marginal edges extending therebetween;

a rail attached to the bottom surface of said worksurface and extending along at least one of said marginal edges, said rail being U-shaped and including sidewalls and a cross wall connecting the sidewalls, said sidewalls engaging said bottom surface and said cross wall being spaced therefrom, said cross wall including a longitudinally extending recess and first apertures located in said recess so that headed fasteners can be extended through said first apertures into said worksurface to secure said rail to said worksurface with the heads of the headed fasteners being located in the recess, said rail sidewalls including second apertures adapted to receive fasteners for attaching mounting brackets thereto;

a pedestal:

a bracket for securing said rail to said pedestal; and bracket engaging fasteners securing said bracket to said rail, said bracket engaging fasteners engaging selected of said second apertures, whereby said rail reinforces and supports said worksurface and further said rail rests on said pedestal and is secured thereto with the heads of the headed fasteners being located in the recess so that the heads do not interfere with resting said rail on said pedestal and also so that said second apertures are exposed for attaching mounting brackets thereto.

23. A furniture unit for workstations and the like, comprising:

a worksurface including a top surface, a bottom surface and marginal edges defined therebetween;

a rail having a U-shaped cross section attached to said worksurface proximate to one of said edges, said rail including opposing sidewalls and a plurality of spaced apertures located longitudinally along said rail in both of said sidewalls;

a plurality of accessory units adapted to equip said workstation; and a bracket for releasably mounting selected of said accessory units to said rail, said bracket including a bayonet-like leg releasably engaging one or more of said spaced apertures in each of said sidewalls and further including an accessory unit engaging end extending in cantilever from said rail for engaging and supporting said selected accessory units with said selected accessory units extending above said workstation, whereby said one or more accessory units can be selected and positioned along said rail on one or more of said brackets to personalize and equip said furniture unit as desired.

24. A furniture unit as defined in claim 23 wherein said accessory units include a privacy screen, and said bracket accessory unit engaging end includes a portion adapted to attach to said privacy screen and further includes a bumper adapted to rest on said top surface and stabilize said privacy screen.

25. A furniture unit as defined in claim 23 wherein said bracket accessory unit engaging end includes upwardly oriented apertures, and including an intermediate prong assembly with prongs spaced and sized for engagement with said upwardly oriented apertures, said intermediate prong assembly further including an upper portion adapted to releasably engage one of said accessory units.

26. A furniture unit as defined in claim 25 wherein said accessory units are adapted to mateably engage said intermediate prong assembly on said bracket to space said accessory above said top surface, and said several accessory units are also adapted to be positioned in a free condition directly on said top surface.

27. A furniture unit for workstations, comprising:

a worksurface including a top surface, a bottom surface and marginal edges extending therebetween;

a rail attached to the worksurface reinforcingly supporting same and being located proximate one of the edges, said rail including opposing sidewalls and a plurality of spaced first apertures located longitudinally along said rail sidewalls, said rail further including a plurality of second apertures;

a base for supporting said worksurface at a predetermined height, said base including bracket means for attaching to said second apertures so that said worksurface is secured to said base but said rail sidewalls are exposed for selectively accessing said first apertures; and brackets having bayonet-shaped legs for mateably engaging said first apertures, said brackets being configured to support accessories proximate said top surface.

28. A furniture unit as defined in claim 27 including a pair of said rails, both of which include accessible first apertures but which are located at different marginal edges.

29. A furniture unit as defined in claim 27 wherein said first apertures are slots and said second apertures are holes, and further said first and second apertures are located alternatingly along the length of said rail.

* * * * *